US012114826B2

(12) United States Patent
Kremmel

(10) Patent No.: US 12,114,826 B2
(45) Date of Patent: Oct. 15, 2024

(54) POCKET HANDLE BEND TAB FOR AN APPLIANCE

(71) Applicant: Haier US Appliance Solutions, Inc., Wilmington, DE (US)

(72) Inventor: Aldo Vincent Kremmel, Palmyra, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 101 days.

(21) Appl. No.: 17/965,081

(22) Filed: Oct. 13, 2022

(65) Prior Publication Data

US 2024/0122439 A1 Apr. 18, 2024

(51) Int. Cl.
*A47L 15/42* (2006.01)

(52) U.S. Cl.
CPC ..... *A47L 15/4265* (2013.01)

(58) Field of Classification Search
CPC ..... A47L 15/4257; A47L 15/4259; A47L 15/4265; D06F 39/14; D06F 39/10; D06F 58/10; D06F 58/20; A47B 2095/026; A47B 2095/027; A47B 95/02; F25D 23/028; F25D 23/04; F25D 23/08; F25D 2323/02; F25D 2323/023; A21B 3/02; F24C 15/02; F24C 15/024; F24C 15/028
USPC ..... 134/56 D, 57 D, 58 D; 126/190, 192, 126/194
See application file for complete search history.

(56) References Cited

U.S. PATENT DOCUMENTS 1,249,910 A * 12/1917 Deginder ..... B65D 43/164 312/328
1,929,772 A * 10/1933 Christian ..... A47B 95/02 16/439
2,105,706 A * 1/1938 Stamy ..... B60R 13/04 24/295
2,142,953 A * 1/1939 Raymond ..... A47B 95/02 403/252
3,473,187 A * 10/1969 Clark ..... A47B 95/02 16/419
5,944,398 A * 8/1999 Wu ..... H05K 7/18 312/265.3
6,099,095 A * 8/2000 Irace ..... A47B 47/02 312/265.5
7,007,347 B2 * 3/2006 Roels ..... A47B 88/944 16/415

(Continued)

FOREIGN PATENT DOCUMENTS

CN 108301686 A * 7/2018
DE 19907233 A1 * 8/2000 ..... A47L 15/4257

(Continued)

*Primary Examiner* — Andrew Roersma
(74) *Attorney, Agent, or Firm* — Dority & Manning, P.A.

(57) ABSTRACT

A household appliance includes a cabinet defining a chamber, a door assembly mounted to the cabinet to selectively restrict access to the chamber, the door assembly includes a front panel defining a handle cavity. The door assembly also includes a pocket handle received in the handle cavity, the pocket handle having a flange with a plurality of tab passages. A plurality of bend tabs are positioned around the handle cavity and received in a first position through the plurality of tab passages. The bend tabs are deformable into a second position where they engage the flange to secure the pocket handle to the front panel.

16 Claims, 10 Drawing Sheets

(56) References Cited

U.S. PATENT DOCUMENTS

| | | | | |
|---|---|---|---|---|
| 10,478,040 | B1 * | 11/2019 | Ford, Jr. | A47L 15/4259 |
| 2016/0265836 | A1 * | 9/2016 | Hong | F25D 23/02 |
| 2019/0038021 | A1 * | 2/2019 | Penna Costa | F16B 12/08 |
| 2020/0060509 | A1 * | 2/2020 | Ponkshe | A47L 15/4293 |

FOREIGN PATENT DOCUMENTS

| | | | | | |
|---|---|---|---|---|---|
| DE | 102018107869 | B3 | | 9/2019 | |
| GB | 509162 | A | * | 7/1939 | |
| GB | 1386977 | A | * | 3/1975 | A47B 47/0075 |
| KR | 20070113636 | A | | 11/2007 | |
| KR | 20170139802 | A | | 12/2017 | |
| WO | WO-2011134738 | A2 | * | 11/2011 | E05B 1/0015 |

* cited by examiner

POCKET HANDLE BEND TAB FOR AN APPLIANCE

FIELD OF THE INVENTION

The present subject matter relates generally to pocket handles for household appliances, such as dishwasher appliances.

BACKGROUND OF THE INVENTION

Dishwasher appliances generally include a tub that defines a wash chamber and a door rotatably coupled with the cabinet for providing selective access to the wash chamber. Certain dishwasher appliances include a pocket handle. The pocket handle is disposed within the door, and a user may insert his or her fingers into the pocket handle to pull the door open.

In manufacturing, such as manufacturing appliances, parts can be put together in stages or steps. Each component added to a manufacturing piece can add a step to assembly and installation of the components into the manufacturing piece. Additionally, having many components in a manufacturing piece increases part count and cost, and can complicate or extend repair time. For example, placing parts together with screws increases component cost and takes time, both during manufacturing and when making repairs.

Door handles, such as pocket door handles, can be a separate piece of material that are mounted to a door panel. Such may be beneficial due to structure, cost, or features desired. Handles of this kind may be inserted into a front panel of a door from the inner side of the front panel. A handle installed this way may be installed with several threaded fasteners, such as screws, which are each an extra part to source, each takes valuable installation time, and generally slow the process as screws may need to be aligned into their screw holes.

Accordingly, a pocket handle that is installed on a door panel without the use of separate fasteners would be useful.

BRIEF DESCRIPTION OF THE INVENTION

The present subject matter provides a pocket handle for an appliance that reduces the number, or eliminates, of threaded fasteners required for installation. Aspects and advantages of the invention will be set forth in part in the following description, may be apparent from the description, or may be learned through practice of the invention.

In one exemplary aspect, a household appliance comprising a cabinet defining a chamber is provided. A door assembly defining a vertical, lateral, and transverse direction is mounted to the cabinet to selectively restrict access to the chamber. The door assembly includes a front panel defining a handle cavity with a pocket handle received in the cavity and comprising a flange defining a plurality of tab passages. A plurality of bend tabs are positioned around the handle cavity and extend from the front panel into a door cavity of the door assembly. The plurality of bend tabs are received through the plurality of tab passages in a first position. The bend tabs are deformable into a second position where the plurality of bend tabs engage the flange to secure the pocket handle to the front panel.

In another example aspect, a door assembly for an appliance is provided. The door assembly comprises a front panel defining a handle cavity and a pocket handle received in the handle cavity, the pocket handle including a flange defining a plurality of tab passages. A plurality of bend tabs are positioned around the handle cavity and extend from the front panel into a door cavity of the door assembly. The plurality of bend tabs are received through the plurality of tab passages in a first position. The bend tabs are deformable into a second position where the plurality of bend tabs engage the flange to secure the pocket handle to the front panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
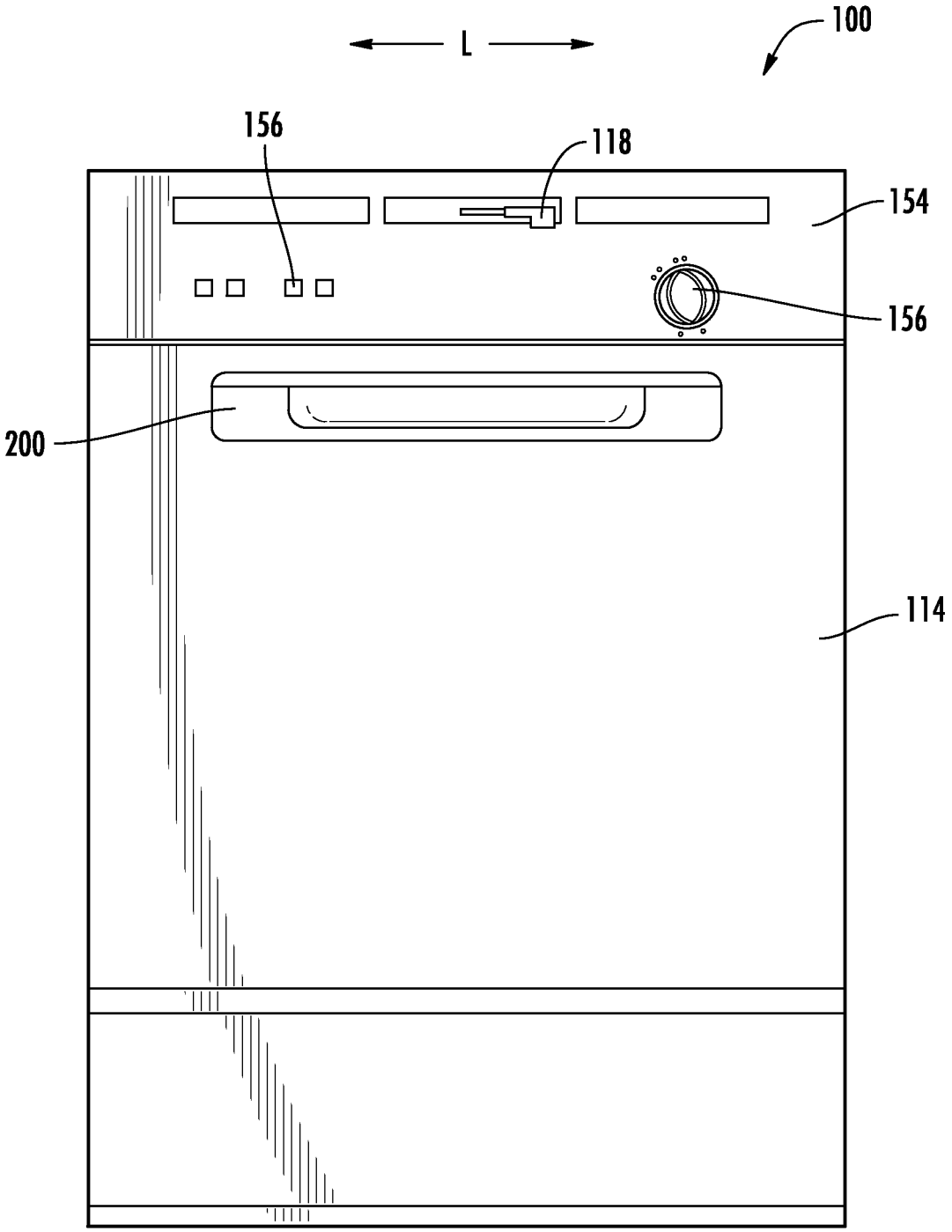
FIG. 1 provides a front elevation view of an exemplary embodiment of a dishwasher appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles. Such may be after completion of the wash cycle or may be a cycle unto itself. The term "drain cycle" is intended to refer to one or more periods of time during which the dishwashing appliance operates to discharge soiled water from the dishwashing appliance. The term "cleaning cycle" is intended to refer to one or more periods of time that may include a wash cycle, rinse cycle, or a drain cycle. The term "wash fluid" refers to a liquid used for washing or rinsing the articles and is typically made up of water that may include other additives such as detergent or other treatments. The term "rinse fluid" refers to a fluid used for rinsing the articles and is typically made up of water and may include other additives such as rinse aid solutions. The term "quick-wash" is intended to refer to the various features described in exemplary embodiments of the invention and does not limit the invention to any particular time period for using such features. The term "wash" is intended to refer or reference the fluid or process of adding detergent to water to remove dirt and particles from articles to be washed. The term "rinse" is intended to refer or reference the fluid or process of using water and potentially rinse aid additives to remove residual soil, detergents, or other undesirable elements that were retained by the articles.

As will be understood by those skilled in the art, dishwasher appliance 100 is provided by way of example only, and the present subject matter may be used in any suitable household appliance. Thus, the present subject matter may be used with other dishwasher appliances having different configurations, including more or less rack assemblies, more or less spray assemblies, etc. The present subject matter may further be used with other household appliances such as microwave ovens, washing machine appliances, dryer appliances, oven appliances, refrigerator appliances, etc. Dishwasher appliance 100 will be described below, with the understanding that other embodiments may include or be provided as another suitable household appliance (e.g., a household appliance defining an internal chamber).

Figure 2:
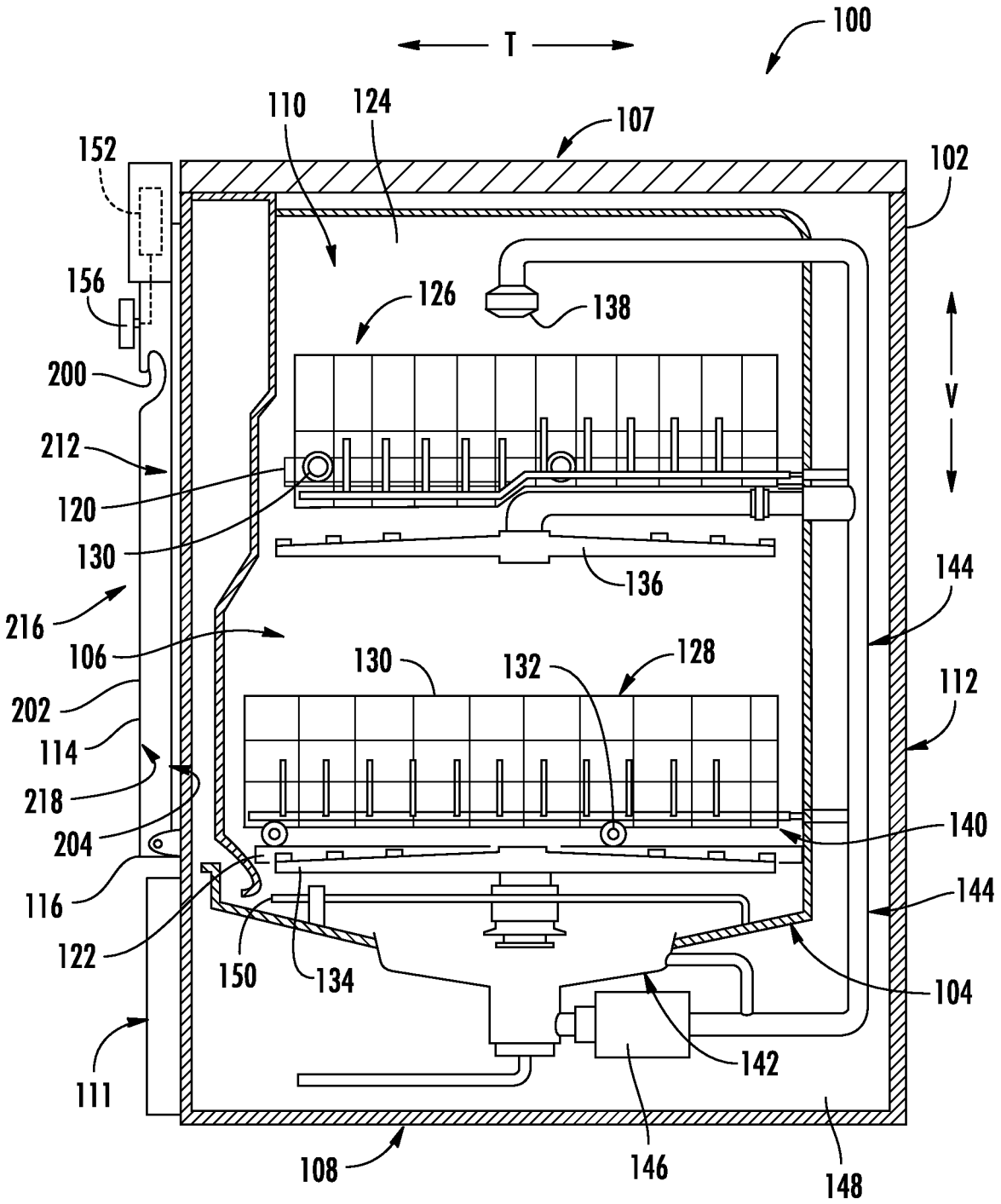
FIG. 2 provides a side, section view of the exemplary dishwasher appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher appliance 100 includes a cabinet 102 (FIG. 2) having a tub 104 therein that defines a wash chamber 106, wash chamber 106 being an interior chamber. As shown in FIG. 2, tub 104 extends between a top 107 and a bottom 108 along a vertical direction V, between a pair of opposing side walls 110 along a lateral direction L, and between a front side 111 and a rear side 112 along a transverse direction T. Each of the vertical direction V, lateral direction L and transverse direction T are mutually perpendicular to one another. References to these orthogonal directions when specifically describing a door assembly, door 114, are based on door 114 being in a closed position as shown in FIGS. 1 and 2.

In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of appliance 100. By contrast, cabinet 102 may enclose some or all interior portions. It should be appreciated that cabinet 102 may have any suitable size, shape, and configuration while remaining within the scope of the present subject matter.

The tub 104 includes a front cabinet opening (not shown) and a door 114 hinged at its bottom 116 for movement between a normally closed vertical position (shown in FIGS. 1 and 2), wherein the wash chamber 106 is sealed shut for washing operations, and a substantially horizontal open position for loading and unloading of articles from the dishwasher 100. Door 114 is mounted on cabinet 102 to selectively restrict access to the internal chamber (e.g., wash chamber 106) in a closed position. Door 114 includes pocket handle 200 mounted thereto, which will be described in more detail below. Latch 118 is used to lock and unlock door 114 for access to wash chamber 106.

At least one rack assembly is slidably positioned within wash chamber 106 and is configured for the receipt of articles for cleaning. For the exemplary embodiment shown in FIG. 2, opposing tub side walls 110 accommodate a plurality of rack assemblies. More specifically, upper and lower guide rails 120, 122 are mounted on tub side walls 124 and accommodate roller-equipped rack assemblies 126 and 128. Each of the rack assemblies 126, 128 may be fabricated into lattice structures including a plurality of elongated members 130 (for clarity of illustration, not all elongated members making up assemblies 126, 128 are shown in FIG. 2). Each rack assembly 126, 128 is adapted for movement between an extended loading position (not shown), in which the rack 126 or 128 is substantially positioned outside the wash chamber 106, and a retracted position (shown in FIGS. 1 and 2), in which the rack 126 or 128 is located inside the wash chamber 106. This rack movement is facilitated by rollers 130 and 132, for example, mounted onto racks 126 and 128, respectively. A silverware basket (not shown) may be removably attached to rack assembly 128 for placement of silverware, utensils, and the like that are otherwise too small to be accommodated by the racks 126, 128. Although guide rails 120, 122 and rollers 130, 132 are illustrated herein as facilitating movement of the respective rack assemblies 126, 128, it should be appreciated that any suitable sliding mechanism or member may be used according to alternative embodiments. In some embodiments, dishwasher appliance 100 may accommodate a different number of rack assemblies and supporting guide rails. For example, dishwasher appliance 100 may accommodate only first rack assembly 126 with accompanying guide rails. In another example, dishwasher appliance 100 may accommodate a third rack assembly (not pictured) with accompanying guide rails. The third rack assembly may be located vertically above rack assemblies 126, 128.

At least one spray assembly is located in wash chamber 106 and is configured to direct wash fluids onto at least one rack assembly for washing articles located therein. For the exemplary embodiment of FIG. 2, dishwasher appliance 100 further includes a plurality of spray assemblies 134, 136, 138 for urging a flow of water or wash fluid onto the articles placed within wash chamber 106. More specifically, as illustrated in FIG. 2, dishwasher appliance 100 includes a lower spray-arm assembly 134 that is rotatably mounted within a lower region 140 of the wash chamber 106 and above a tub sump assembly 142 so as to rotate in relatively close proximity to rack assembly 128. Additionally or alternatively, a mid-level spray-arm assembly 136 may be located in an upper region of the wash chamber 106 and may be located in close proximity to upper rack 126. Also, additionally or alternatively, an upper spray assembly 138 may be located above the upper rack 126.

The lower, mid-level, and upper spray-arm assemblies 134, 136, 138 may be part of a fluid circulation assembly 144 for circulating water and dishwasher fluid in the tub 104. The fluid circulation assembly 144 may also include a recirculation pump 146 positioned in a machinery compartment 148 located below the tub sump assembly 142 of the tub 104. Pump 146 may receive fluid from sump assembly 142 to provide a flow to fluid circulation assembly 144, or optionally, a switching valve or diverter (not shown) may be used to select flow. In some embodiments, a heating element 170 can be used to provide heat during e.g., a drying cycle.

Each spray-arm assembly 134, 136 may include an arrangement of discharge ports or orifices for directing washing fluid received from pump 146 onto dishes or other articles located in rack assemblies 126 and 128. The arrangement of the discharge ports in spray-arm assemblies 124, 128 can provide a rotational force by virtue of washing fluid flowing through the discharge ports. The resultant rotation of the spray-arm assemblies 126, 128 and the operation of fluid circulation assembly 144 using fluid from pump 146 provides coverage of dishes and other dishwasher contents with a washing spray. Other configurations of spray assemblies may be used as well.

The dishwasher 100 is further equipped with a controller 152 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 152 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

The controller 152 may be positioned in a variety of locations throughout dishwasher 100. In the illustrated embodiment, the controller 152 may be located within a control panel area 154 of door 114 as shown in FIGS. 1 and 2. In some such embodiments, input/output ("I/O") signals may be routed between the controller 152 and various operational components of dishwasher 100 along wiring harnesses that may be routed through the bottom 116 of door 114. Typically, the controller 152 includes a user interface panel/controls 156 through which a user may select various operational features and modes and monitor progress of the dishwasher 100. In some embodiments, the user interface 156 represents a general purpose I/O ("GPIO") device or functional block. In additional or alternative embodiments, the user interface 156 includes input components, such as one or more of a variety of electrical, mechanical, or electro-mechanical input devices including rotary dials, push buttons, and touch pads. The user interface 156 may include a display component, such as a digital or analog display device designed to provide operational feedback to a user. The user interface 156 may be in communication with the controller 152 via one or more signal lines or shared communication busses.

Dishwasher appliance 100 may also be configured to communicate wirelessly with a cloud-server that may include a database or may be, e.g., a cloud-based data storage system and may also include image recognition and processing capabilities including artificial intelligence as further described below. For example, appliance 100 may communicate with cloud-server over the Internet, and appliance 100 may access via WI-FI®, such as from a WI-FI® access point in a user's home or through a mobile device. Alternatively, dishwasher appliance 100 may be equipped with such image recognition and processing capabilities as part of controller 152 or other components onboard appliance 100.

It should be appreciated that the invention is not limited to any particular style, model, or configuration of dishwasher appliance 100. The exemplary embodiment depicted in FIGS. 1 and 2 is for illustrative purposes only. For example, different locations may be provided for user interface 156, different configurations, including providing one or more rack assemblies 126, 128 and one or more spray assemblies 136, 138, to dishwasher appliance 100 may be used, different configurations may be provided for rack assemblies 126, 128 different spray assemblies 136, 138 and spray manifold configurations may be used, and other differences may be applied while remaining within the scope of the present subject matter.

As will be understood by those skilled in the art, dishwasher appliance 100 is provided by way of example only, and the present subject matter may be used in any suitable household appliance. Thus, present subject matter may further be used with other household appliances having different configurations such as microwave ovens, washing machine appliances, dryer appliances, refrigerator appliances, etc. Dishwasher appliance 100 will be described below, with the understanding that other embodiments may include or be provided as suitable for another household appliance (e.g., an appliance defining an internal chamber).

Figure 3:
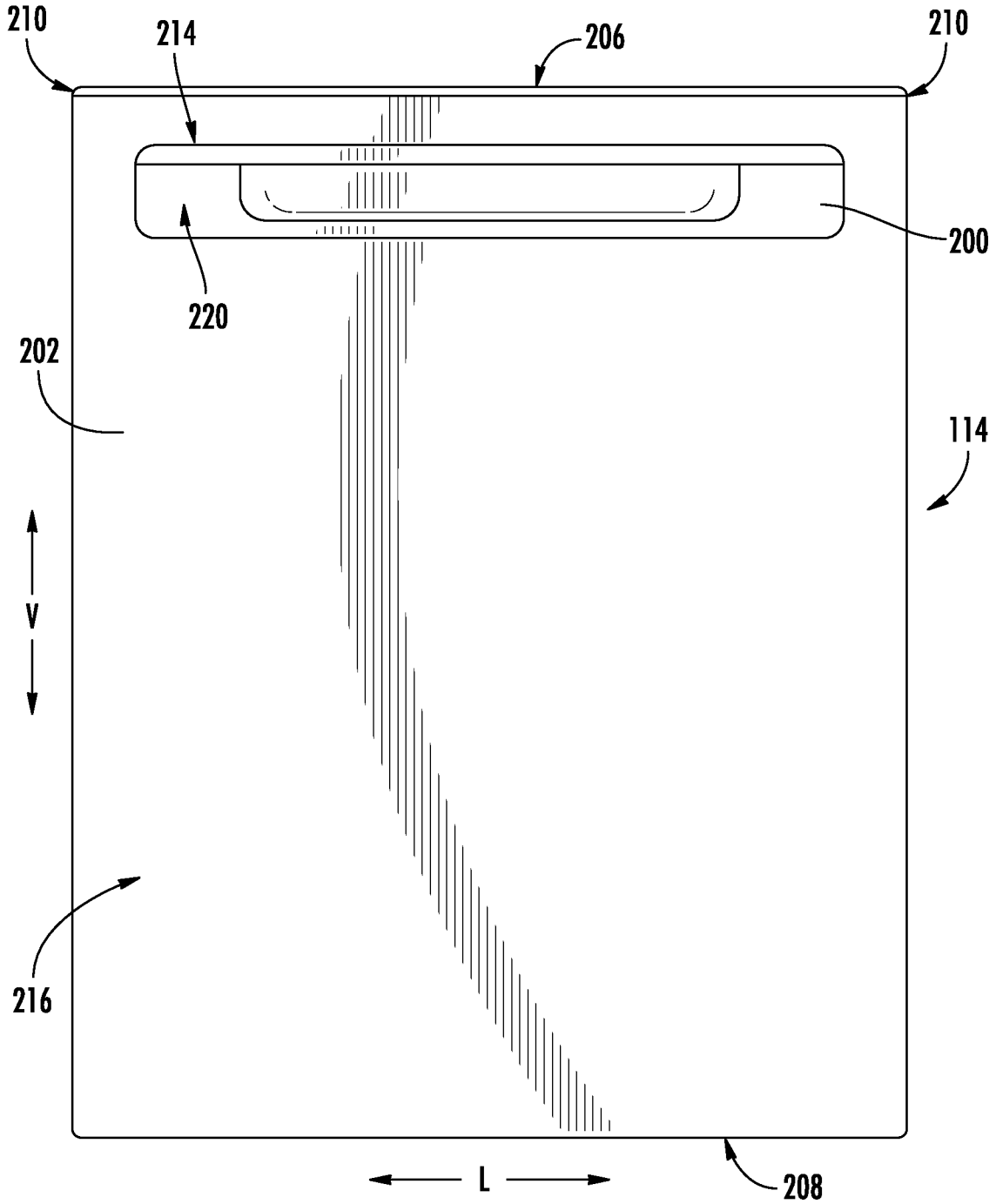
FIG. 3 provides a front elevation view of an exemplary door of the exemplary dishwasher appliance of FIG. 1.

Turning to FIGS. 2 and 3, door 114 includes a front panel 202 and an interior panel 204. Door 114 extends between front panel 202 and interior panel 204 in the transverse direction T, extends between a top lip 206 and a bottom lip 208 in the vertical direction and extends laterally between side panels 210 when in the closed position. As shown, door 114 defines a door cavity 212, the door cavity 212 defined as between front panel 202 and interior panel 204, door cavity 212 extending transversely into the door when the door is in the closed position. Door cavity 212 is internal to door 114. In the illustrated embodiment, door 114 further includes a front surface 216. Front surface 216 is an outward surface of front panel 202, and the transversely forward surface of door 114 when door 114 is in the closed position.

A rear surface 218 of front panel 202 is opposite front surface 216, that is it is an inward-facing surface of front panel 202.

Exemplary embodiments of the present description may advantageously allow a handle to be installed on door 114 from rear surface 218 of front panel 202. Furthermore, embodiments disclosed herein may advantageously facilitate installation of a pocket handle without the use of threaded fasteners, for example screws. Further still, embodiments disclosed herein may advantageously facilitate installation of a pocket handle without the use of any separate components, i.e., separate from the door 114 and pocket handle 200. In other words, the connection between the pocket handle 200 and the rest of the door 114 may be notably free of any additional components. Exemplary embodiments may be useful for easier installation or repair or replacement of the handle on the door 114 due, for example, the lack of separate fasteners, threaded or not, during installation.

Door cavity 212 extends internal to door 114. In some embodiments, door cavity 212 extends transversely between rear surface 218 of front panel 202 and interior panel 204. In some embodiments, door cavity 212 extends laterally and transversely within door 114, with front panel 202 and interior panel 204 defining two of the edges thereof. Door cavity 212 is defined as the space interior to door 114. Door cavity 212 is defined transversely forward by front panel 202 and transversely rearward by interior panel 204. Door cavity 212 is transversely in front of wash chamber 106 when door 114 is in the closed position.

In some embodiments, front panel 202 defines a handle cavity edge 214, which may be a terminal edge or lip of front panel 202, inwardly directed from the perimeter or an outer edge of front panel 202. For instance, handle cavity edge 214 may define a void by extending continuously about the void inward from a front surface 216 of front panel 202. The void about which handle cavity edge 214 extends may, at least in part, define a handle cavity 220. Handle cavity edge 214 may, in turn, extend around handle cavity 220. As shown in FIG. 3, handle cavity 220 extends vertically (V) and laterally (L) when door 114 is in the closed position. Size and shape of the handle cavity 220 may be selected such that at least a portion of a pocket handle 200 is received within the door 114 at the handle cavity edge 214.

Figure 4:
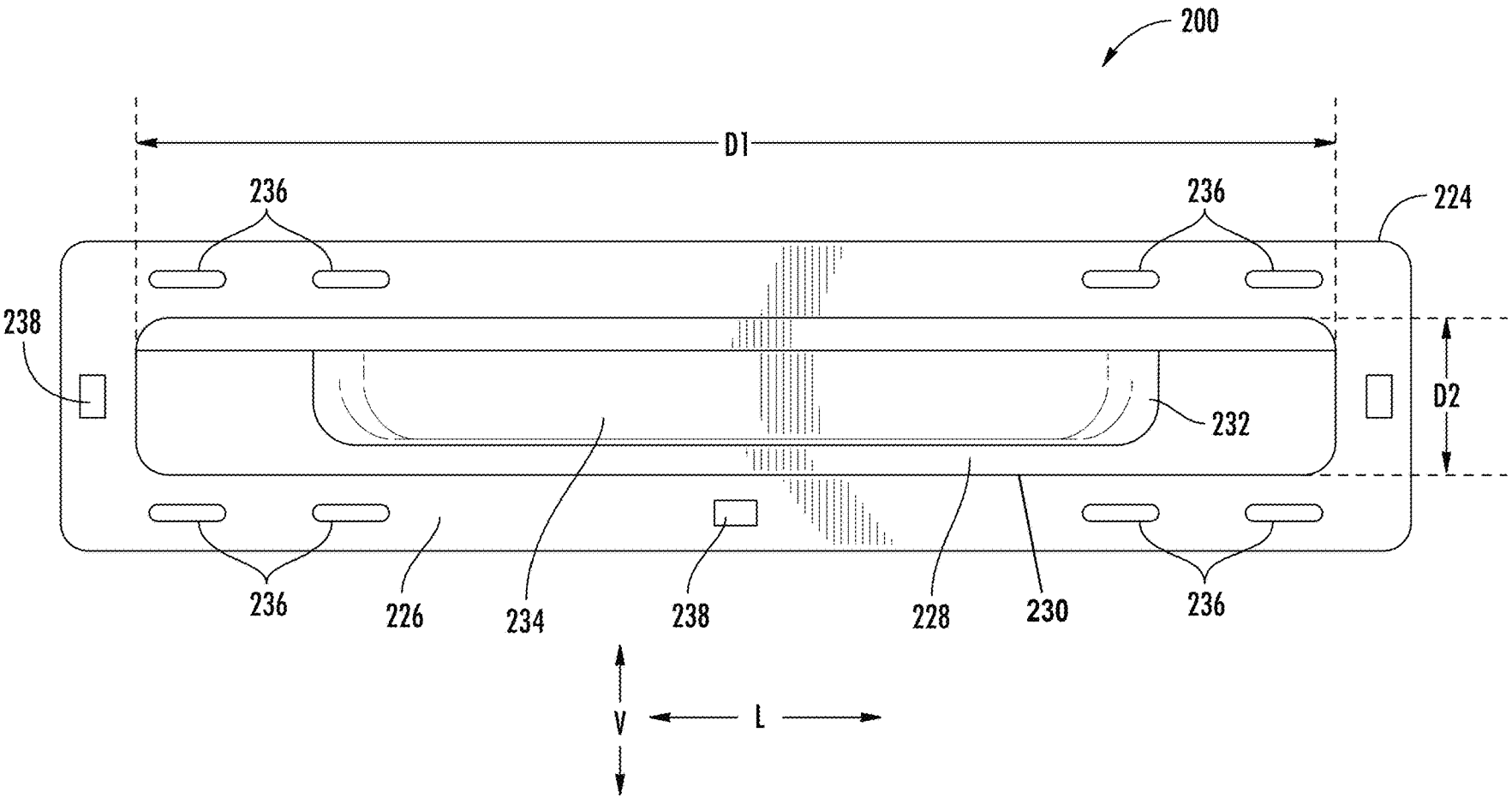
FIG. 4 provides a front elevation view of an embodiment of an exemplary pocket handle.

In the embodiment of FIG. 4, pocket handle 200 includes a mounting flange, flange 224 with a raised surface 228 centrally disposed on the flange mounting surface 226 and extending in an outward (transverse, T) direction from the flange 224. That is, the raised surface 228 "stands proud" of the flange 224 and the flange mounting surface 226. Raised surface edge 230 defines the outer perimeter of raised surface 228 and is selected such that raised surface edge 230 is receivable within door 114 at handle cavity edge 214. Flange 224 dimensions in the V and L directions extend beyond the raised surface edge 230. When received at handle cavity edge 214, the V, L, and T directions of the pocket handle 200 of FIG. 4 correspond with the L, V, and T directions of handle cavity 220 of FIG. 3.

Flange 224 provides a mounting surface 226 that surrounds the perimeter of the flange 224. The flange 224 surrounds the raised surface 228 on all sides and extends beyond the raised surface edge 230 in the L and V directions, as illustrated in FIG. 4. The mounting surface 226 is coplanar, or substantially coplanar, with the raised surface 228. The flange 224 defines a plurality of tab passages 236 and a plurality of alignment passages 238 formed as through holes in the flange 224 from the mounting surface 226 to the inner surface 240 of the flange 224. Eight tab passages 236 and three alignment passages 238 are shown in FIG. 4 for ease of illustration. In embodiments, more or fewer tab passages or alignment passages can be used; in some embodiments no alignment passages may be used.

Figure 5:
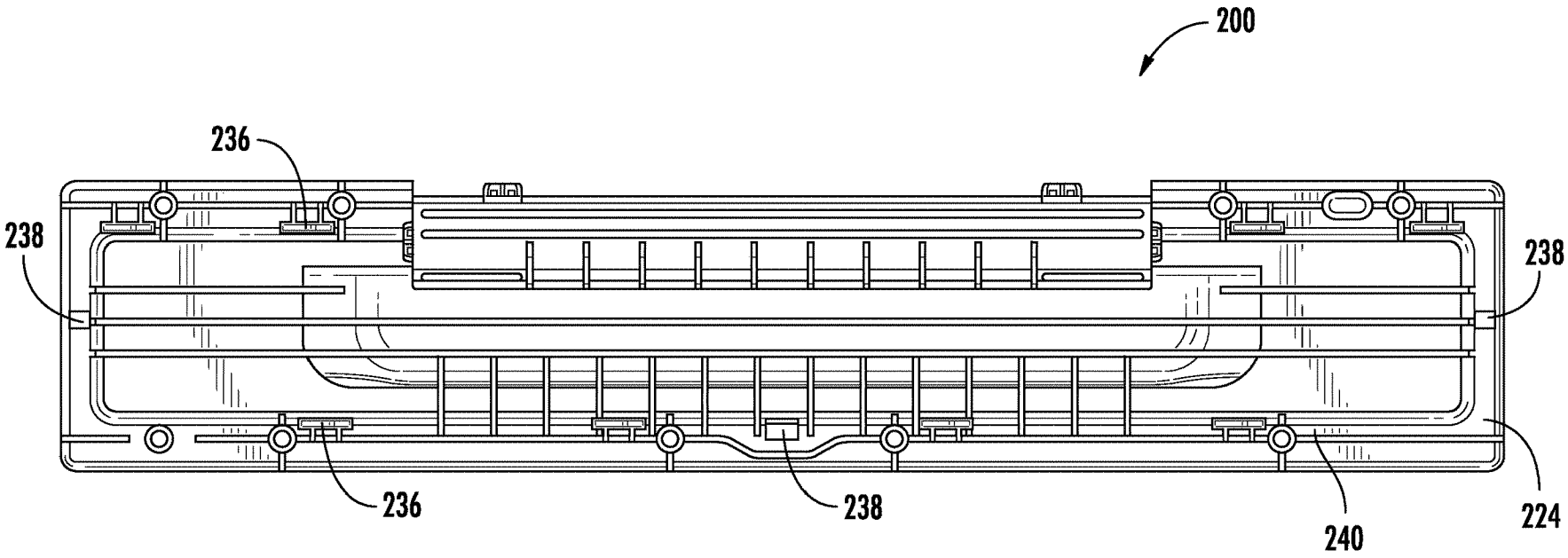
FIG. 5 represents rear elevation view of the exemplary pocket handle of FIG. 4.

FIG. 5 is representative of a rear elevation view of a pocket handle 200 in accordance with the present disclosure. The eight tab passages 236 of FIG. 4 are shown as through holes, extending through the flange 224 to the inner surface 240 of the pocket handle 200. Similarly, the three alignment passages 238 are illustrated as through holes passing through the flange 224.

Figure 6:
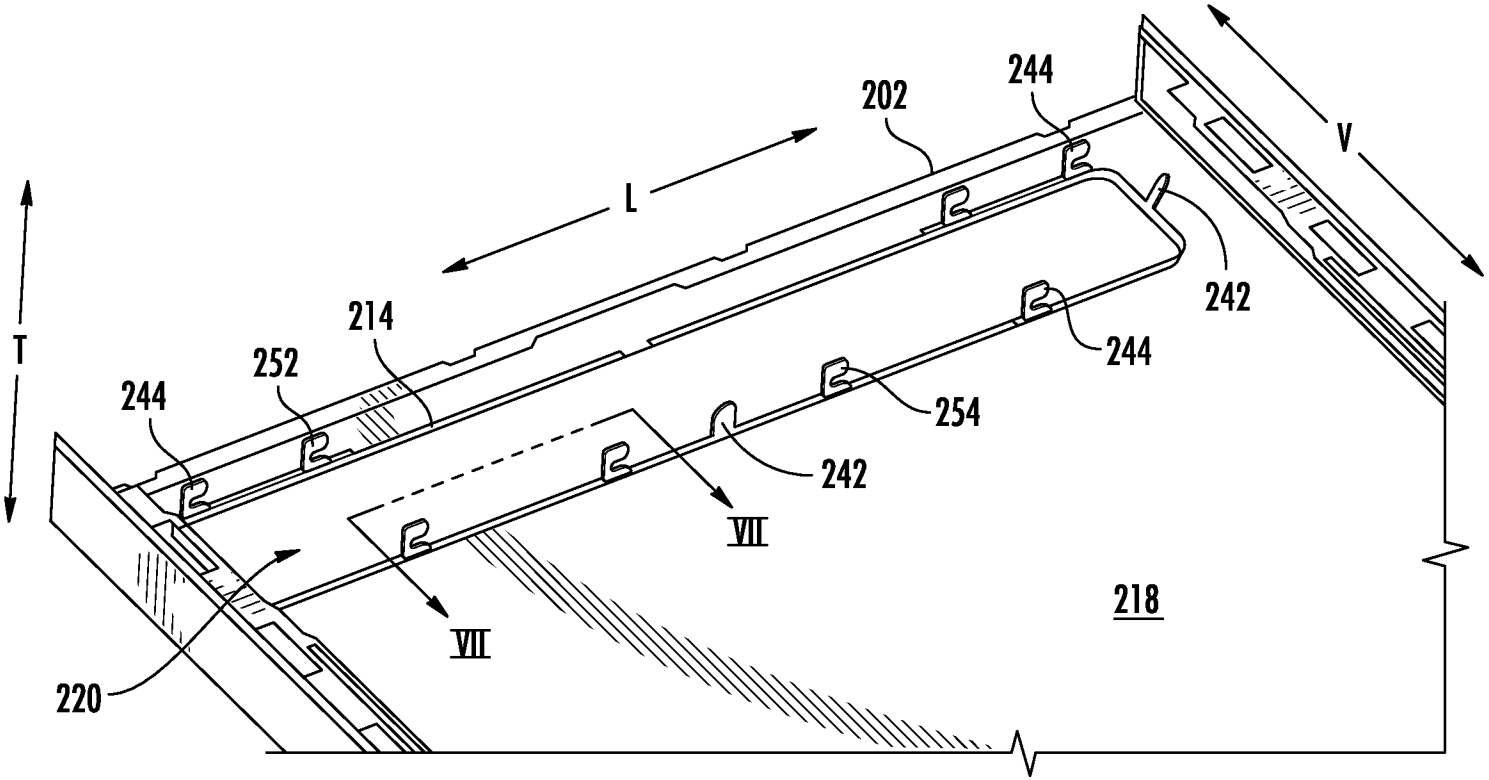
FIG. 6 provides a perspective view of the rear surface of a front panel of an exemplary door of the present disclosure.

To facilitate receipt of pocket handle 200 at handle cavity edge 214, present embodiments include a plurality of tabs disposed at the handle cavity edge 214 and extending into the door cavity 212. For example, as shown in FIG. 6, alignment tabs 242 and bend tabs 244 may be spaced around the handle cavity edge 214 at various locations. As illustrated, alignment tabs 242 and bend tabs 244 are perpendicular to front panel 202 and perpendicular to rear surface 218 of front panel 202. Alignment tabs 242 cooperate with alignment passages 238 formed in pocket handle 200 to advantageously position the pocket handle 200 within the handle cavity 220 such that the raised surface edge 230 is at the handle cavity edge 214. In embodiments, each alignment tab 242 cooperates with an alignment passage 238 to facilitate proper placement of the pocket handle 200 within the handle cavity 220 such that the raised surface edge 230 is at the handle cavity edge 214. In some embodiments, there are more alignment passages 238 than alignment tabs 242.

Bend tabs 244 as illustrated in FIG. 5 are positioned along the upper and lower lateral edges of handle cavity edge 214 for ease of illustration. Bend tabs 244 may be located at any point around the handle cavity edge 214, including the left and right vertical edges. The bend tabs 244 are deformable between an undeformed first position (e.g., FIG. 7) for receipt in the tab passages 236 and a deformed second position for secure attachment of the pocket handle 200 to the front panel 202. In the undeformed state the bend tabs are generally perpendicular to the rear surface 218 of the front panel 202 and can pass at least partially through tab passages 236. The bend tabs 244 are deformable along a bend axis, for example axis B-B (FIG. 10) to a second, deformed state in which relative motion between the pocket handle 200 and the front panel 202 is prevented, or substantially prevented, locking the pocket handle 200 to the front panel 202.

To facilitate secure attachment or mounting of the pocket handle 200 to the front panel 202 in an abutting relationship, with raised surface edge 230 at handle cavity edge 214, bend tabs 244 are positioned to be received in tab passages 236 in flange 224. Secure attachment limits, or eliminates and prevents, relative motion between the pocket handle 200 and the front panel 202 and keeps the pocket handle 200 tight and flush with the front panel 202. Location of the bend tabs 244 is selected to cooperate with the tab passages 236 when the raised surface edge 230 is at handle cavity edge 214. Bend tabs 244 may beneficially provide alignment in addition to attachment.

Figure 7:
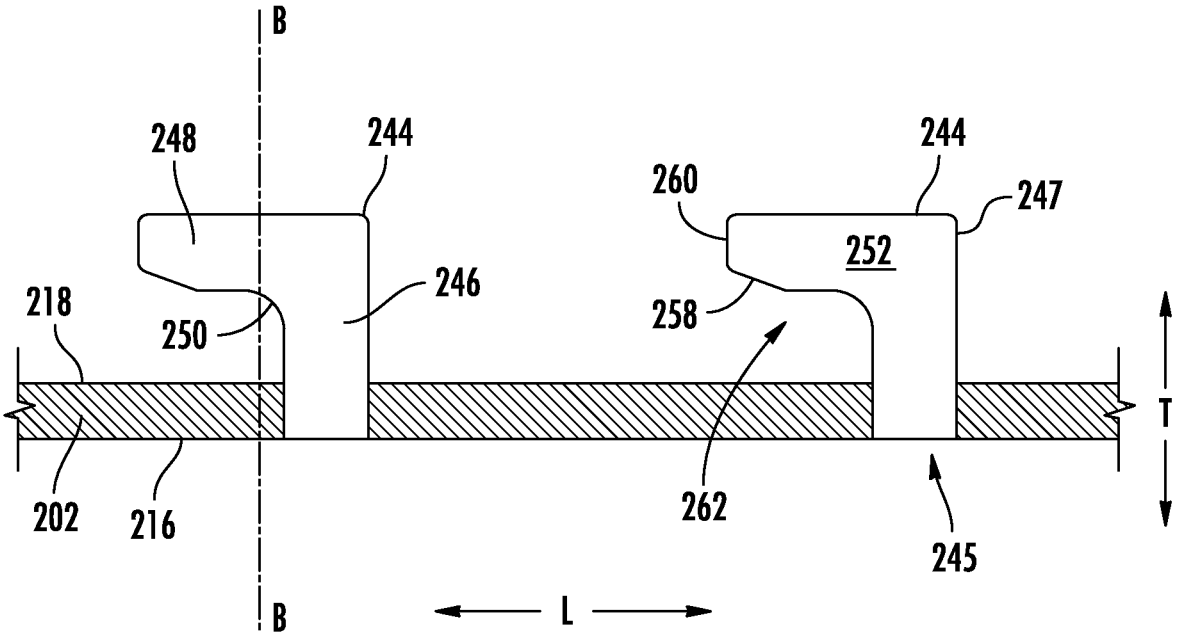
FIG. 7 is partial cross-sectional view taken along VII-VII in FIG. 6 providing an enlarged view of exemplary bend tabs of the present disclosure.

FIG. 7 is a partial sectional view taken along VII-VII of FIG. 6 to illustrate an embodiment of bend tabs 244. In accordance with an embodiment, bend tabs 244 include a post 246 and an arm 248 joined by a transition area 250 as illustrated in FIG. 7. When undeformed, bend tabs 248 are planar, or substantially planar, in the L-T plane, extending in the transverse direction T perpendicular, or substantially perpendicular, to the front surface 216 and rear surface 218 of the front panel 202. In particular, post 246 is an elongate, upright member affixed to or extending from front panel 202 at a first end 245 and extending in the transverse direction T to a second end 247. In some embodiments, bend tabs 244 are integrally formed with the front panel 202 in the V-L plane and subsequently bent to the L-T plane as illustrated.

Figure 9:
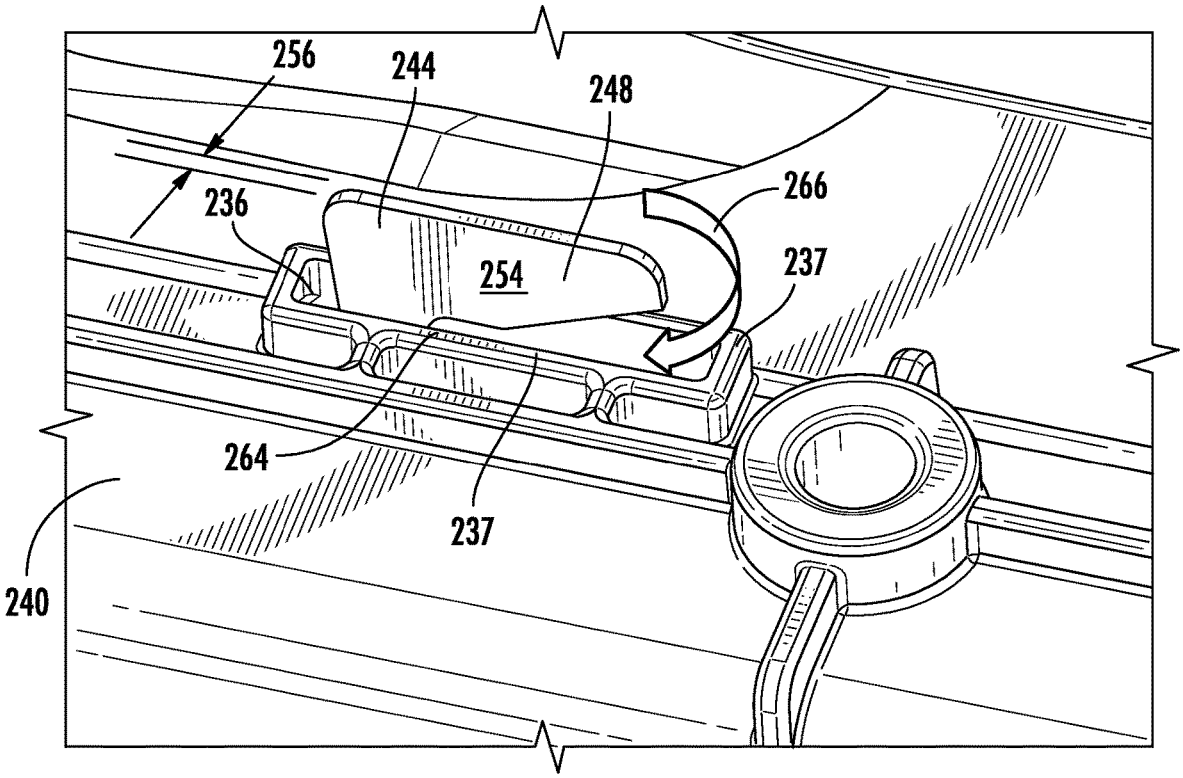
FIG. 9 represents an enlarged view of a bend tab received in a bend tab passage in accordance with an embodiment of the present disclosure.

As illustrated in FIG. 7, arm 248 extends in a lateral direction L from post 246, extending in one direction from the post. Bend tabs 244 include a tab inner face 252 directed to the handle cavity 220 and a tab outer face 254 directed away from the handle cavity 220. Tab inner face and outer face 252, 254 are parallel and define a tab thickness 256 (FIG. 9). Tab inner face and outer face 252, 254 are substantially parallel to the upper and lower lateral edges of handle cavity 220 when undeformed. Discussions regarding directional details of the bend tabs 244 are referenced with the front panel 202 of the door 114 in the closed position of FIGS. 1-3 and only with regard to the bend tabs as illustrated in FIG. 6 (i.e., only on the lateral L edges of handle cavity 220).

FIG. 7 is illustrative of bend tabs 244 in accordance with an embodiment of the present disclosure. Arm 248 includes an inclined edge 258 joining the terminal end 260 of the arm 248 with the transition area 250. Inclined edge 258 is a transversely inner edge of the arm proximate to the rear surface 218 of the front panel 202. Transition area 250 may be a radius joining a portion of post 246 with the tab inclined edge 258.

Bend tabs 244 may be deformable, for example bendable, in some planes and in some directions. In some embodiments, a bend axis B-B, about which a portion of bend tab 244 may bend, passes through the transition area 250 substantially in the L-T plane and parallel to the transverse T direction. Bend tabs 244 may be bendable about the B-B axis in one or more directions.

A portion of the bend tab 244 may form an edge geometry 262. In embodiments, the transition area 250, the inclined edge 258, the tab inner face 252, and the tab outer face 254 form an edge geometry 262 on at least some of the plurality of bend tabs 244. The edge geometry 262 may facilitate mounting the flange 224 of the pocket handle 200 to the front panel 202 of the door 114 at the handle cavity edge 214.

Figure 8:
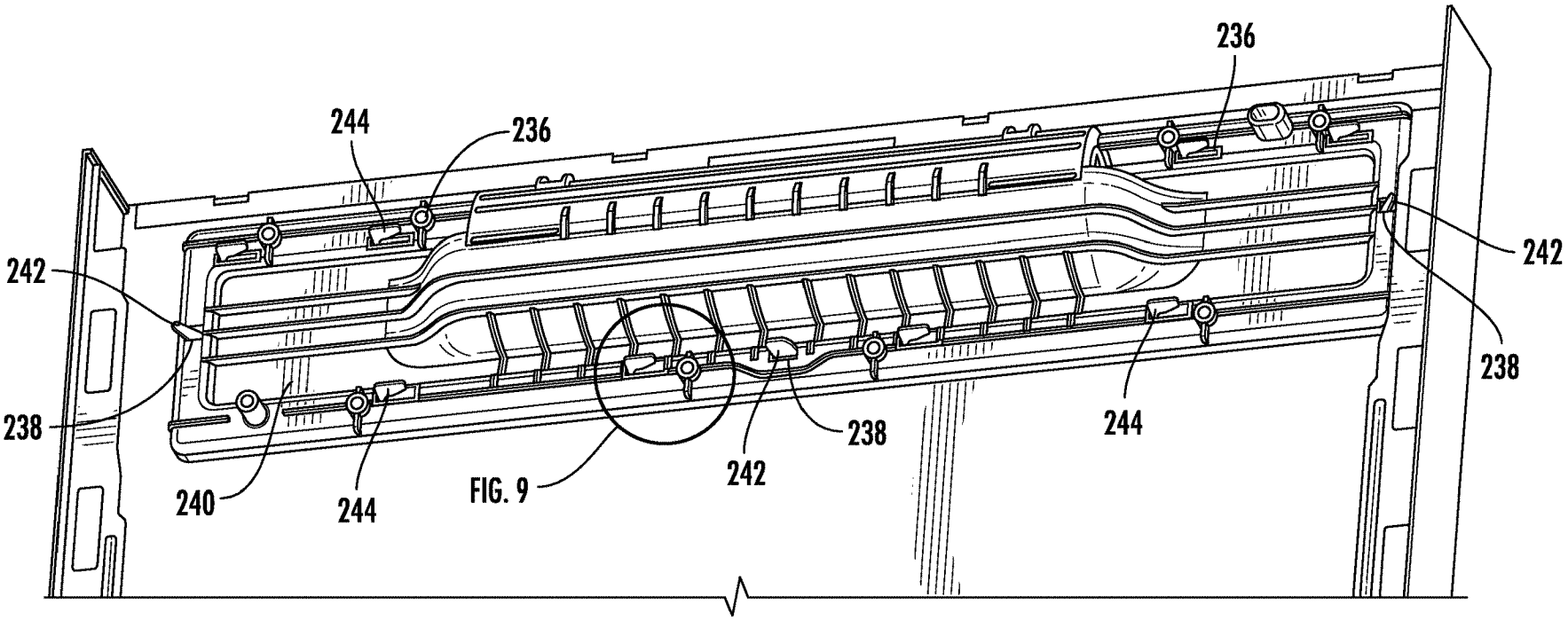
FIG. 8 represents a rear elevation view of a representative pocket handle and a front panel in accordance with the present disclosure.

When the pocket handle 200 is mounted to the front panel 202 such that the flange 224 is abutting the rear surface 218 of front panel 202 and the raised surface edge is accepted in the handle cavity 220 at the handle cavity edge 214, bend tabs 244 are received in tab passage 236 as illustrated in FIG. 8. Alignment tabs 242, if used, are received in alignment passages 238 when pocket handle 200 is mounted as above.

FIG. 9 is an enlarged view (as indicated in FIG. 8) of a representative bend tab 244 received in and passing through tab passage 236. As illustrated, in some embodiments, inner surface 240 of pocket handle 200 includes a plurality of walls 237 adjacent to the tab passages 236 and perpendicular to the inner surface 240. In some embodiments, the walls 237 extend at least partially around a perimeter of the tab passage 236 and are perpendicular, or substantially perpendicular, to the inner surface 240. In the exemplary mounted position shown in FIGS. 8 and 9, edge geometry 262 of bend tabs 244 is proximate to wall 237. The walls 237 provide a surface, interference surface 264, that may engage with edge geometry 262 to attach pocket handle 200 to the rear surface 218 of the front panel 202 with an interference fit when one or more bend tabs 244 are in the second, deformed state. A portion of edge geometry 262 may lodge against a portion of the walls 237 to create the interference fit. When the pocket handle 200 is mounted to the front panel 202, incline edge 258 and interference surface 264 are in an opposing orientation with at least a portion of the inclined edge 258 within the walls 237 and a portion of the inclined edge 258 transversely spaced away from the walls 237 (i.e., spaced apart in the T direction from interference surface 264).

Figure 10:
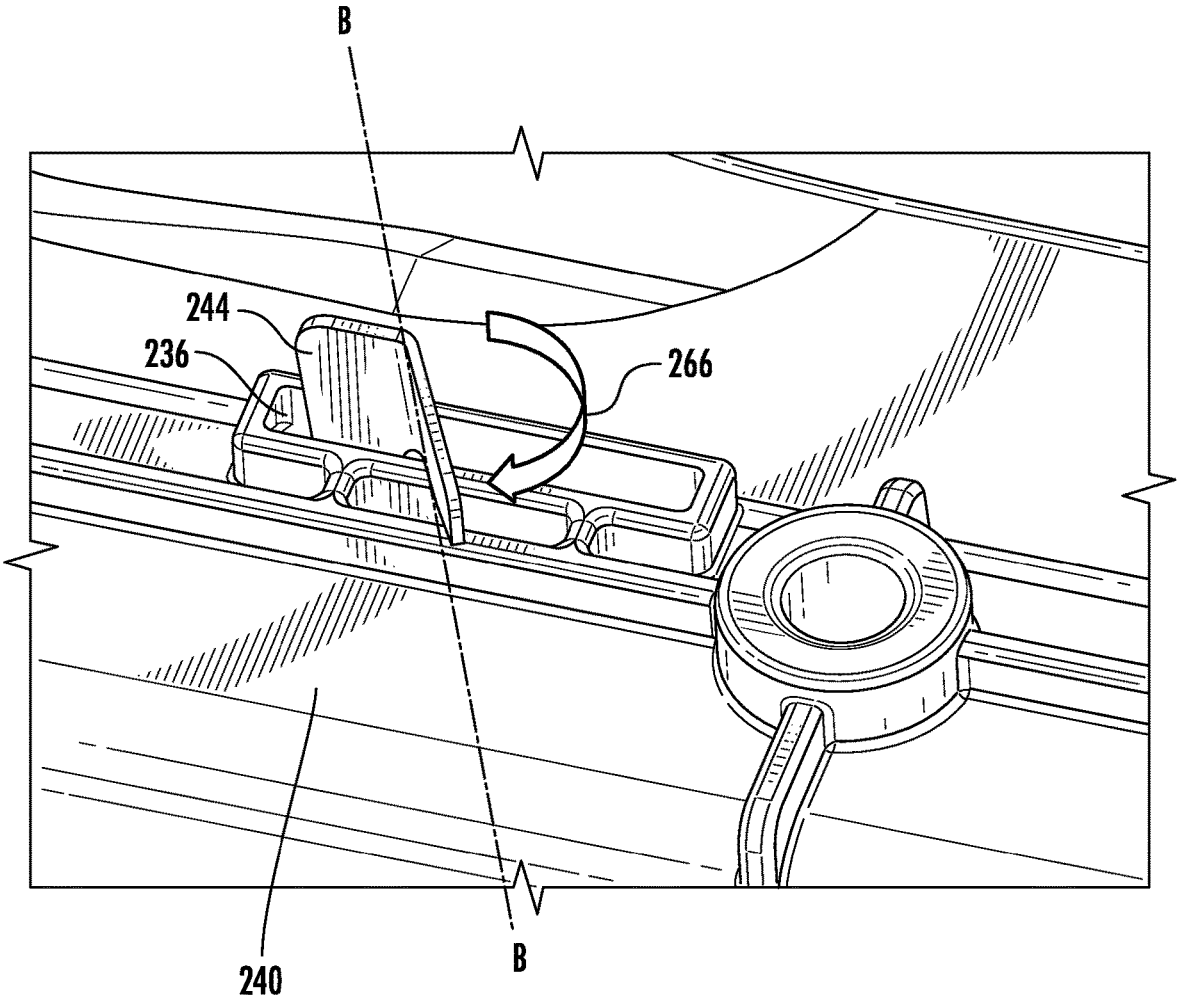
FIG. 10 represents an enlarged view of the bend tab of FIG. 9 deformed to engage the flange in accordance with an embodiment of the present disclosure.

To attach the pocket handle 200 to the front panel 202, arm 248 is subject to a torque 266 applied in the exemplary direction 266 to bend the arm 248 about bend axis B-B as illustrated in FIG. 10. At least a portion of post 246 of bend tab 244 is constrained against the influence of torque 266 within the tab passage 236 and walls 237. In particular, post 246 is supported against rotational displacement by the tab passage 236 and walls 237.

A portion of arm 248 may bend about the bend axis B-B in response to the torque 266, lodging a portion of the edge geometry 262 against a portion of the walls 237. As arm 248 rotates as shown under the applied torque 266, at least a portion of the edge geometry 262, for example the tab inclined edge 258, contacts interference surface 264. Contact between the inclined edge 258 and the interference surface 264 creates a clamping force to secure the pocket handle to the front panel 202. The rotation of bend tab 244 under the applied torque 266 may displace tab inner face 252 and tab outer face 254 from a parallel orientation with the upper and lower lateral edges of the handle cavity 220. Various edge geometries 262 may require more or less rotation of the arm 248 to achieve a desired clamping force. Torque 266 may be applied about the bend axis B-B in either a clockwise or counterclockwise direction (as viewed along bend axis B-B).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A household appliance comprising:

a cabinet defining a chamber;

a door assembly defining a vertical, lateral, and transverse direction, the door assembly being mounted on the cabinet to selectively restrict access to the chamber, the door assembly comprising:

a front panel defining a handle cavity;

a pocket handle received in the handle cavity, the pocket handle comprising a flange defining a plurality of tab passages; and a plurality of bend tabs positioned around the handle cavity and extending from the front panel into a door cavity of the door assembly, the plurality of bend tabs being received through the plurality of tab passages in a first position and being deformable into a second position where the plurality of bend tabs engage the flange to secure the pocket handle to the front panel, each bend tab of the plurality of bend tabs comprises:

a post perpendicular to a rear surface of the front panel;

an arm perpendicular to the post and extending in one direction from the post, the post and the arm joined by a transition area; and an edge geometry including at least an inclined edge between the post and a terminal end of the arm, the transition area defining a radius joining the post with the inclined edge.

2. The household appliance of claim 1, wherein the plurality of bend tabs are perpendicular to the rear surface of the front panel in the first position.

3. The household appliance of claim 1, wherein the post and the arm are coplanar in the first position.

4. The household appliance of claim 1, wherein the inclined edge is proximate to the rear surface of the front panel.

5. The household appliance of claim 1, wherein a portion of the edge geometry engages the flange in an interference fit.

6. The household appliance of claim 1, wherein the pocket handle further comprises a raised surface edge disposed on the flange, the raised surface edge received at the handle cavity.

7. The household appliance of claim 1, wherein an inner surface of the pocket handle comprises a plurality of walls extending at least partially around a perimeter of the tab passages.

8. The household appliance of claim 7, wherein the plurality of bend tabs engage the plurality of walls in an interference fit.

9. A door assembly for an appliance, the door assembly comprising:

a front panel defining a handle cavity;

a pocket handle received in the handle cavity, the pocket handle comprising a flange defining a plurality of tab passages; and a plurality of bend tabs positioned around the handle cavity and extending from the front panel into a door cavity of the door assembly, the plurality of bend tabs being received through the plurality of tab passages in a first position and being deformable into a second position where the plurality of bend tabs engage the flange to secure the pocket handle to the front panel, each bend tab of the plurality of bend tabs comprises:

a post perpendicular to a rear surface of the front panel;

an arm perpendicular to the post and extending in one direction from the post, the post and the arm joined by a transition area; and an edge geometry including at least an inclined edge between the post and a terminal end of the arm, the transition area defining a radius joining the post with the inclined edge.

10. The door assembly of claim 9, wherein the plurality of bend tabs are perpendicular to the rear surface of the front panel in the first position.

11. The door assembly of claim 9, wherein the post and the arm are coplanar in the first position.

12. The door assembly of claim 9, wherein the inclined edge is proximate to the rear surface of the front panel.

13. The door assembly of claim 9, wherein a portion of the edge geometry engages the flange in an interference fit.

14. The door assembly of claim 9, wherein the pocket handle further comprises a raised surface edge disposed on the flange, the raised surface edge received at the handle cavity.

15. The door assembly of claim 9, wherein an inner surface of the pocket handle comprises a plurality of walls extending at least partially around a perimeter of the tab passages.

16. The door assembly of claim 15, wherein the plurality of bend tabs engage the plurality of walls in an interference fit.

* * * * *